United States Patent [19]

Feinberg

[11] 4,356,431

[45] Oct. 26, 1982

[54] MAGNETRON ENERGIZING CIRCUIT

[75] Inventor: Albert E. Feinberg, Chicago, Ill.

[73] Assignee: Advance Transformer Company, Chicago, Ill.

[21] Appl. No.: 879,261

[22] Filed: Feb. 21, 1978

[51] Int. Cl.[3] ..... H05B 39/00; H05B 41/14

[52] U.S. Cl. ..... 315/101; 219/10.55 B; 315/39.51; 315/105; 331/86; 328/262

[58] Field of Search ..... 315/39.51, 101, 105; 328/253, 262; 331/86, 87; 219/10.55 B

[56] References Cited

U.S. PATENT DOCUMENTS

| | | | |
|---|---|---|---|
| 3,396,342 | 8/1968 | Feinberg | 328/262 |
| 3,413,559 | 11/1968 | Jorgenson et al. | 328/262 X |
| 3,684,978 | 8/1972 | Otaguro | 328/253 |
| 3,732,504 | 5/1973 | Levinson | 331/86 |
| 4,017,702 | 4/1977 | Harmon et al. | 331/86 |

*Primary Examiner*—Saxfield Chatmon, Jr.
*Attorney, Agent, or Firm*—Silverman, Cass & Singer, Ltd.

[57] ABSTRACT

Microwave oven with a self-regulating circuit operated from a low voltage a.c. source based upon a substantially constant current transformer and condenser series combination and having a return path for current on alternate half cycles. For defrosting food the magnetron is operated at partial power which is achieved by decreasing the voltage applied to the magnetron. This is done either by increasing the capacitive reactance in series with the secondary of the transformer or by decreasing the secondary voltage. Switching problems are solved by providing the arrangement of the invention at the grounded end of the transformer secondary. The self-regulating circuit is required to be of the type which has one end of the secondary winding grounded.

5 Claims, 3 Drawing Figures

MAGNETRON ENERGIZING CIRCUIT

BACKGROUND OF THE INVENTION

The field of the invention is microwave heating circuits and particularly the invention is concerned with a circuit for use in a microwave oven designed to cook food.

One of the most wide-spread circuits in use today for energizing magnetron ovens is that of U.S. Pat. No. 3,396,342, the particular one of the circuits disclosed in that patent which is most popular being the half-wave voltage doubler circuit of FIG. 5. As a result of this circuit, many low-priced microwave ovens are in use today, these ovens being used under a wide variety of conditions which call into play the inherent self-regulating characteristic of the magnetron energizing circuit. As such the number of controls on many of these ovens is minimal, economy calling for the circuitry to include as few components as possible.

Microwave ovens are used extensively to defrost frozen food and in some instances this is the most important use of the oven. In defrosting food it is not desirable to use the maximum power available through normal use of the circuit even where the timing for cooking is available to maintain the cooking cycle for a low duration. One way of using the oven for defrosting is to cycle the energizing circuit in periods of no power and full power, but this procedure stresses the magnetron while at the same time inducing high current surges in the primary winding of the transformer leading to early break-down of the insulation.

In order to obviate the magnetron stress accompanying the on-off cycle type of defrosting technique one can provide an independent filament transformer for the magnetron which remains energized during the on-off cycle. The most economical way of building magnetron energizing circuits of the type disclosed in the above-identified patent is to have the filament of the magnetron energized by means of a winding that is mounted on the same core as the secondary winding that energizes the magnetron anode, using the primary winding coupled to both secondary and filament windings. It can be appreciated that the addition of a completely independent filament transformer increases the cost of the circuit substantially. Timers and relays are also expensive and call for high reliability which increases cost.

In the interest of economy a transformer that is made for use in a circuit which enables one side of the secondary to be grounded will have the start of the high voltage secondary winding grounded to the frame of the transformer. The custom is then to connect the series condenser to the high side of the transformer so that any attempt to switch capacitor terminals must be done at high voltage. These voltages are of the order of 4000 volts peak for a typical half-wave doubler circuit, which calls for expensive components and gives rise to switching problems.

SUMMARY OF THE INVENTION

A magnetron energizing circuit of the type in which there is a high leakage reactance transformer whose secondary winding is connected to a series condenser and the plate of a magnetron, the magnetron being by-passed by a rectifier that provides a return path for alternate half cycles of the voltage. The condenser is always in the a.c. circuit of the transformer secondary because of the flow of current in the magnetron on one half cycle and through the rectifier on the other half cycle. The capacitive reactance of the condenser is greater than the leakage reactance of the transformer as effectively reflected in the secondary winding in series with the condenser so that a leading current flows in the secondary circuit thereby producing a substantially constant current effect notwithstanding variations in the primary voltage, the load upon the magnetron and variations in the characteristics of the circuit components.

In such a circuit the transformer secondary is normally connected directly to ground at one end thereof. According to the invention, this low voltage end terminal of the transformer is not connected to ground directly but instead is connected to ground through a series capacitor having a parallel switch. The capacitor is of a capacitive reactance to decrease the power output of the magnetron so that when connected in the circuit the oven powered by the magnetron may be used for defrosting but there will be no adverse effects on the self-regulating feature of the energizing circuit. When the switch is closed, the capacitor is by-passed and the circuit operates as normal with full power.

An alternating form of the circuit has the normally grounded end terminal and a tap located a few turns from the end terminal connected to the contacts of a single pole double throw switch whose armature is connected to ground. Thus, the two positions of the switch provide normal or reduced power to the magnetron. Regulation is to a degree worsened by this arrangement, but not completely eliminated. The invention contemplates special switching arrangements to eliminate arcing and surges in the transformer secondary which could also be harmful to the magnetron.

DESCRIPTION OF THE PREFERRED EMBODIMENTS

The invention is concerned with improvements upon the magnetron energizing circuits of U.S. Pat. No. 3,396,342 and hence for a complete explanation of the theory of operation and the construction of the basic circuit reference should be had to that patent.

Basically, the circuit of U.S. Pat. No. 3,396,342 is a magnetron energizing circuit which operates on the basis of a substantially constant current transformer condenser combination. By having the secondary of the transformer loosely coupled to the primary to give rise to a high leakage reactance and providing a capacitive reactance in the series circuit so that a leading current flows through the circuit at all times, the circuit is self-regulating. There is saturation in the transformer core in the vicinity of the secondary winding during operation. The magnetron is a diode-type of device which passes current in only one direction, but it is by-passed by a rectifier so that while the magnetron is energized with pulsed d.c. and the rectifier passes current on alternate half cycles, the condenser is always in the a.c. circuit of the secondary of the transformer and produces the substantially constant current effect.

The result of this type of arrangement is that the current output of the transformer remains constant to a great degree notwithstanding variation in line voltage applied to the transformer primary winding, variations in the load to which the magnetron is subjected, variations in the characteristics of the circuit components which occur through aging or stress or during manufacture. Most importantly, the circuit suppresses peaks of the magnetron current so that increasing the output deliberately merely results in broadening the current pulses without peaking them.

Another important feature of the circuit of FIG. 5 of the above-identified patent is that the voltage of the transformer secondary is to a substantial extent increased by reason of doubling action so that a low voltage secondary not capable of producing sufficient voltage to cause the firing of a certain magnetron may be useful for this purpose because the circuit increases the voltage available to the magnetron.

Figure 1:
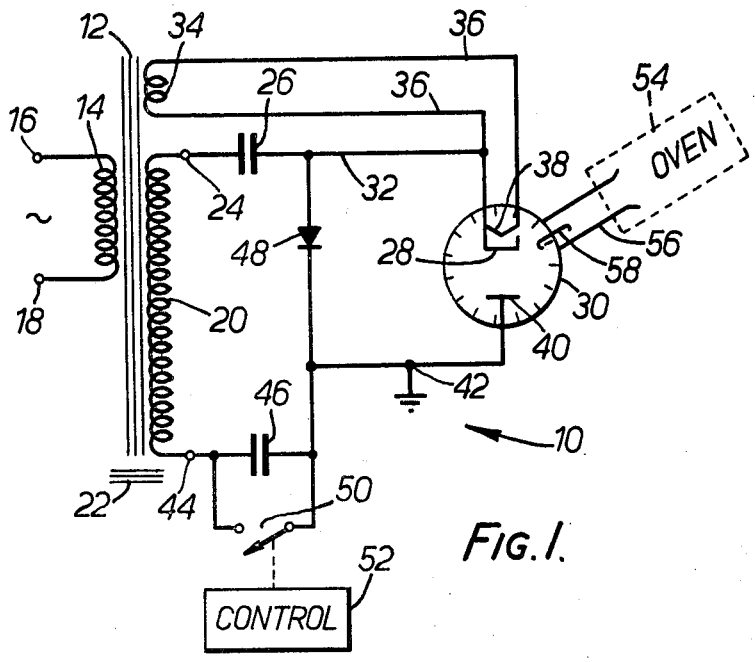
FIG. 1 is a circuit diagram of a magnetron energizing circuit embodying the invention.

In FIG. 1 there is illustrated a circuit 10 which embodies the invention used with a half-wave voltage doubler of the type disclosed in FIG. 5 of the above-identified patent. The high voltage transformer 12 has a primary winding 14 which is connected to a source of A.C. by means of the terminals 16 and 18. The high voltage secondary winding 20 is in high leakage reactance relationship to the primary winding 14 as indicated symbolically by the shunt lines 22. Its upper high voltage end terminal 24 is connected through the series capacitor 26 to the cathode 28 of the magnetron 30 by way of the lead 32. The transformer 12 mounts a filament or heater winding 34 closely coupled to the primary winding 14 and connected by way of the leads 36 to the heater or filament 38 of the magnetron 30. The magnetron plate or anode 40 is connected to ground 42, this being conventionally done by having the magnetron frame or housing grounded.

The low voltage end terminal 44 of the transformer 12 is normally connected to ground 42 right at the frame of the transformer, this usually being the start of the transformer winding; hence on the interior of the secondary winding 20 physically and closest to the metal of the core. According to the invention herein, this terminal 44 is not connected to ground but instead is pulled out of the coil when the secondary winding 20 is being formed and is connected to the series condenser 46 which in turn is connected to ground. The magnetron 30 is shunted by the rectifier 48 to provide the return path on alternate half cycles needed to keep the condensers 26 and 46 in continuous a.c. connection to the tranformer secondary 20.

A switch 50 shunts the capacitor 46. When this switch is closed the terminal 44 is grounded and the circuit operates exactly like the circuit of FIG. 5 of the above-identified patent. When the switch 50 is open, however, the condenser 46 is in series with the condenser 26 and their combined capacitance is decreased while their capacitive reactance is increased thereby decreasing the current flow in the circuit. This is because the current in the circuit is already leading and the additional capacitive reactance makes it even more so. The effect is to make less voltage available at the input of the magnetron.

If desired the switch 50 can be operated manually or connected to an automatic control device 52 which could include a timer and the like.

The magnetron 30 transfers its power in the form of very high frequency energy to an oven 54 by way of a transmission line or plumbing 56, the energy being coupled to the transmission line 56 by means of a probe 58 extending from the interior of the magnetron 30 to the transmission line.

Considering a typical arrangement where the magnetron was a 2M53 Hitachi model that operates at a peak voltage of 4100 volts, the transformer primary was connected to a conventional 120 volt, 60 Hertz a.c. source of power and the secondary was constructed to have an R.M.S. voltage output of between 2100 and 2500 volts. The condenser 26 was a one microfarad high voltage condenser. The rectifier 48 was conventional for the voltages encountered. The condenser 46 was chosen to be somewhat less than two microfarads which gave a power decrease of 35%. The rating of the condenser was chosen to be 600 volts because it was connected to the lower end terminal of the transformer 12.

Regulation for these circuit constants was less than ten percent. For the same circuit, increasing the capacitance made the regulation less effective. The following actual test figures were obtained:

| Capacitance | Regulation |
|---|---|
| 1.836 Mfd. | 9.57% |
| 4.305 Mfd. | 11.67% |
| 6.031 Mfd. | 13.37% |

These regulation data are better than regulation for the same circuit operated at full power. The regulation in such case was over 15%. It should be pointed out that the basic circuit is fully capable of much better regulation with higher quality components being used. The tests were made using very economical components because this type of circuit is where the invention will find substantial use. As it turns out, the improvement in regulation was unexpected.

Figure 2:
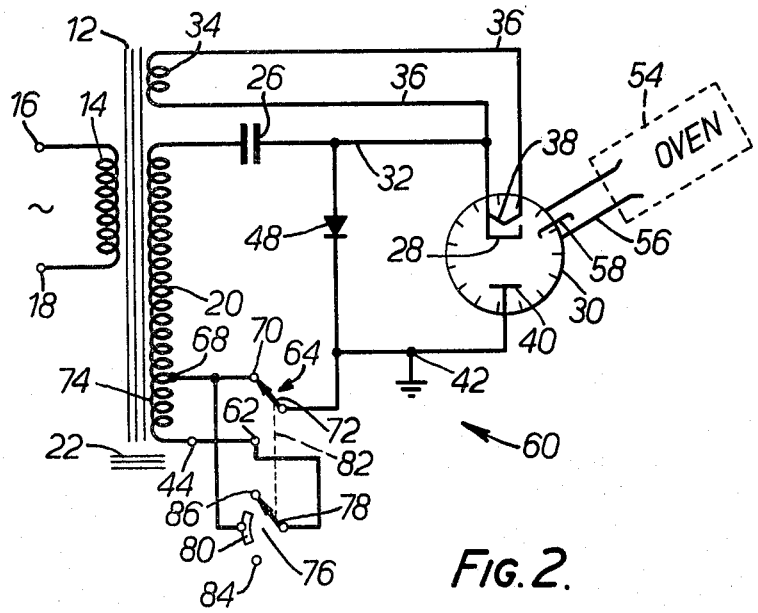
FIG. 2 is a circuit diagram of a modified form of the invention.
Figure 3:
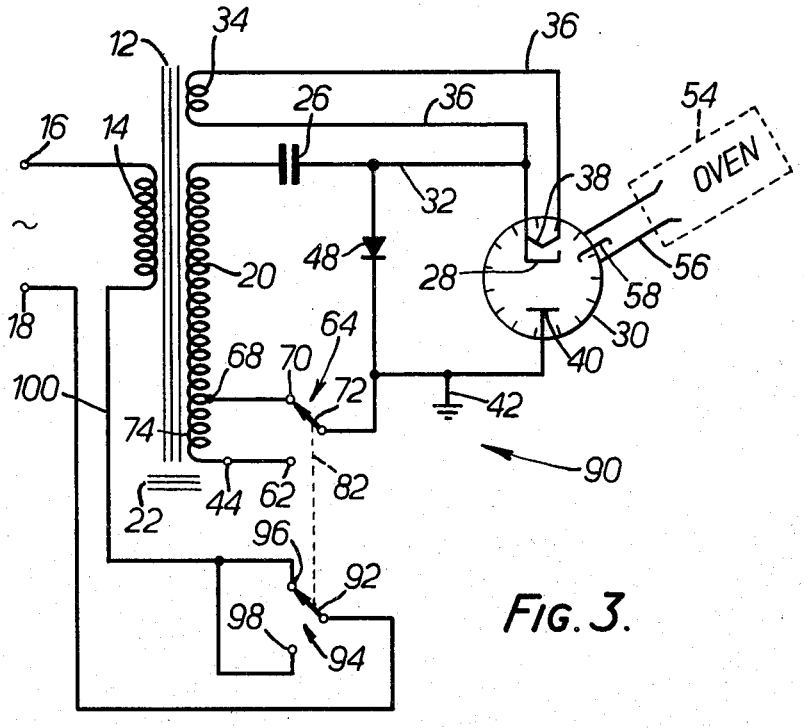
FIG. 3 is a circuit diagram of another modified form of the invention.

FIGS. 2 and 3 illustrate circuits which by-pass turns of the secondary winding to achieve reduced power. In these two figures the same reference characters will be used for the same or equivalent parts as in FIG. 1 wherever feasible.

The circuit 60 of FIG. 2 differs from the circuit 10 in that instead of a condenser such as 46, some turns of the secondary winding are switched in and out of the circuit to achieve the decreased power. The end terminal 44 of the secondary winding 20 which is normally at ground potential is not connected to the frame of the transformer during manufacture. Instead it is pulled out and remains insulated and is connected to the contact 62 of the switch 64. A tap is established at 68 a few layers of turns from the end terminal 44 and this tap is connected to the second contact 70 of the switch 64, the latter being a two-pole single throw switch. The armature 72 of the switch is connected to ground 42.

When the armature 72 is on the contact 62 the circuit 60 is at full power and operates exactly like the circuit 10 when the switch 50 is closed. When the armature 72 of the switch 64 is on the contact 70, those windings which are indicated at 74 are by-passed and the voltage output of the secondary winding 20 is decreased. The number of turns to be included in 74 can be ascertained by computing the proportion of total turns needed to achieve a certain decrease in output voltage. This could be, for example, a few layers of turns.

In order to avoid transients during switching the terminal 44 and the tap 69 may be connected together during switching of the switch 64 by means of a second switch or relay that operates momentarily when the armature 64 is moved. This is illustrated diagrammatically in FIG. 2 by a switch 76 whose armature 78 is connected to the terminal 44 and whose central arcuate contact 80 is connected to the tap 68. The armatures 72 and 78 are ganged as indicated at 82. End positions 84 and 86 correspond in location to the contacts 62 and 70, respectively, and are floating electrically.

The circuit 90 of FIG. 3 differs from the circuit 60 in that instead of simultaneously short circuiting the windings 74 during the switching process for preventing transients, the primary winding 14 is opened to de-energize the secondary winding 20 during the switching. Thus, the switch 64 is the same as the switch 64 of FIG. 2 and has the same effect. It is ganged as at 82 with the armature 92 of a switch 94 that moves between the contacts 96 and 98. These contacts connect with the lead 100 while the armature 92 connects with the lead 102, these leads 100 and 102 being in series with the primary winding 14. While the armature 92 is on either of the contacts 96 and 98 current flows through the primary winding 14, but in the period of time while the armature 92 is moving between contacts, the primary winding 14 is open. Thus there is no voltage in the secondary winding 20 at this time.

The switches 64 and 94 are mechanically arranged in such a manner that the distance which the armature 72 moves between the contacts 62 and 70 is less than the distance which the armature 94 moves between the contacts 96 and 98. In this manner, the sequence of operation is such that no electrical connections are made by the switch 64 while the primary is "live". Accordingly, transients and arcing are eliminated.

The movements of the switches 64 in the case of the circuits 60 and 90 are or can be made quite rapid. The magnetron 30 will not be damaged because the thermal inertia of the cathode 28 will keep it relatively hot during the very short period that such switching takes place. Magnetron cathodes have relatively large mass.

Variations can be made without departing from the spirit or scope of the invention as defined in the appended claims.

What it is desired to secure by Letters Patent of the United States is:

I claim:

1. In a magnetron energizing circuit for energizing a heating magnetron from an a.c. line of relatively low voltage and low frequency and which includes a magnetron having an anode and a cathode, the anode being connected to ground potential, a constant current transformer and condenser means combination which comprises (i) a step-up transformer having a primary winding connected to said a.c. line, (ii) a secondary winding isolated from said primary winding but coupled in high leakage reactance operating relation to said primary winding, said secondary winding having a high voltage end terminal and a low voltage end terminal, and (iii) condenser means connected in series with said secondary winding and to the high voltage end terminal thereof, the cathode of the magnetron being connected to said condenser means so that the condenser means is between the cathode and the high voltage end terminal, a rectifier connected across the magnetron to serve as a return path for current on alternate half cycles of the output voltage when the magnetron is not conducting, the condenser means having a capacitive reactance which is greater than the leakage reactance of the transformer so that the secondary circuit of the transformer has leading current flowing therein at all times, the invention herein which comprises:

means providing alternative connections of the low voltage end of the secondary winding to the magnetron anode, comprising one connection being a conductive path directly to ground potential to enable the energizing circuit to furnish full power to the magnetron and the second connection comprising second condenser means and leads connecting same between said low voltage end and ground potential whereby when said second connection is effective there is formed a loop which contains both condenser means in series with the secondary winding and the rectifier and switch means for selectively rendering effective said one or second connection.

2. The magnetron energizing circuit as claimed in claim 1 in which the low voltage end comprises the low voltage terminal of said secondary winding.

3. The magnetron energizing circuit as claimed in claim 2 in which the second connection is in place continuously, the switch means comprising a switch in series with said one connection and the one connection including said switch being in shunt with said second condenser means whereby when the switch is closed the condenser means are short-circuited and the first connection only is effective while said switch is open, the second connection only is effective.

4. In a magnetron energizing circuit for energizing a heating magnetron from an a.c. line of relatively low voltage and low frequency and which includes a magnetron having an anode and a cathode, the anode being connected to ground potential, a constant current transformer and condenser means combination which comprises (i) a step-up transformer having a primary winding connected to said a.c. line, (ii) a secondary winding isolated from said primary winding but coupled in high leakage reactance operating relation to said primary winding, said secondary winding having a high voltage end terminal and a low voltage end terminal, and (iii) condenser means connected in series with said secondary winding and to the high voltage end terminal thereof, the cathode of the magnetron being connected to said condenser means so that the condenser means is between the cathode and the high voltage end terminal, a rectifier connected across the magnetron to serve as a return path for current on alternate half cycles of the output voltage when the magnetron is not conducting, the condenser means having a capacitive reactance which is greater than the leakage reactance of the transformer so that the secondary circuit of the transformer has leading current flowing therein at all times, the invention herein which comprises:

means providing alternative connections of the secondary winding to the magnetron anode, one connection being a conductive path extending from the low voltage end terminal directly to ground potential to enable the energizing circuit to furnish full power to the magnetron and the second connection comprising a tap on the secondary winding spaced voltage-wise from the low voltage end terminal by a small fraction of the total turns of the secondary winding to provide a substantially lesser voltage across said secondary winding when said tap is at ground potential in lieu of the low voltage end terminal, leads for connecting said tap to ground potential, and switch means for selectively rendering effective said one or second connection, the portion of the secondary winding between said tap and low voltage end terminal being effectively by-passed when said connection is effective, and means for short circuiting the said last-mentioned portion of the secondary winding during the period of time that said switch means are in the process of establishing a connection.

5. In a magnetron energizing circuit for energizing a heating magnetron from an a.c. line of relatively low voltage and low frequency and which includes a magnetron having an anode and a cathode, the anode being connected to ground potential, a constant current transformer and condenser means combination which comprises (i) a step-up transformer having a primary winding connected to said a.c. line, (ii) a secondary winding isolated from said primary winding but coupled in high leakage reactance operating relation to said primary winding, said secondary winding having a high voltage end terminal and a low voltage end terminal, and (iii) condenser means connected in series with said secondary winding and to the high voltage end terminal thereof, the cathode of the magnetron being connected to said condenser means so that the condenser means is between the cathode and the high voltage end terminal, a rectifier connected across the magnetron to serve as a return path for current on alternate half cycles of the output voltage when the magnetron is not conducting, the condenser means having a capacitive reactance which is greater than the leakage reactance of the transformer so that the secondary circuit of the transformer has leading current flowing therein at all times, the invention herein which comprises:

means providing alternative connections of the secondary winding to the magnetron anode, one connection being a conductive path extending from the low voltage end terminal directly to ground potential to enable the energizing circuit to furnish full power to the magnetron and the second connection comprising a tap on the secondary winding spaced voltage-wise from the low voltage end terminal by a small fraction of the total turns of the secondary winding to provide a substantially lesser voltage across said secondary winding when said tap is at ground potential in lieu of the low voltage end terminal, leads for connecting said tap to ground potential, and switch means for selectively rendering effective said one or second connection, the portion of the secondary winding between said tap and low voltage end terminal being effectively by-passed when said connection is effective, and means for opening the primary winding during the period of time that said switch means are in the process of establishing a connection.

* * * * *